United States Patent [19]

Kristiansen

[11] 3,942,303

[45] Mar. 9, 1976

[54] BISCUIT PACKING SYSTEMS

[75] Inventor: Knud Erik Kristiansen, Horsens

[73] Assignee: Thorsted Maskiner A/S, Denmark

[22] Filed: Sept. 13, 1974

[21] Appl. No.: 505,971

[30] Foreign Application Priority Data

Sept. 13, 1973 United Kingdom ..... 43002/73

[52] U.S. Cl. ..... 53/159; 53/247

[51] Int. Cl.[2] ..... B65B 35/22

[58] Field of Search ..... 53/26, 152, 153, 159, 164, 53/247

[56] References Cited

UNITED STATES PATENTS

| | | | |
|---|---|---|---|
| 2,857,721 | 10/1958 | Ardell et al. | 53/153 X |
| 3,545,164 | 2/1970 | Middleton | 53/26 |
| 3,633,739 | 1/1972 | Renner | 53/164 X |
| 3,645,069 | 2/1972 | Waite | 53/247 X |
| 3,657,860 | 4/1972 | Franklin | 53/164 X |
| 3,791,099 | 2/1974 | Wagner | 53/26 |

*Primary Examiner*—Donald R. Schran
*Assistant Examiner*—Leon Gilden
*Attorney, Agent, or Firm*—Craig & Antonelli

[57] ABSTRACT

A method of packing biscuits and similar flat cakes into elongated boxes of the type adapted to receive a pile of biscuits with the axis of the pile extending in the longitudinal direction of the box and with the single biscuits in the pile forming an oblique angle with this direction, the biscuits being filled down into the box through an elongated opening in the top side thereof, whereafter this opening is closed normally by means of a transparent sheet material. The biscuits are successively transferred from the delivery end of a tunnel oven into a fixed delivery position above a piling receptacle and the first biscuit is brought to stand edgewise on a releasable bottom portion of the receptacle and leaned in an inclined position against a displaceable end wall portion of the receptacle, and the end wall portion is displaced a distance corresponding to the thickness of one biscuit, whereafter the next biscuit is brought correspondingly from said delivery position to an inclined position supported by said bottom portion and leaned against said first biscuit, and so forth until the lying pile has the desired length, whereafter the said bottom portion is released so as to cause the entire pile to fall down from the receptacle into a box placed therebeneath. The invention also comprises an apparatus for handling the biscuits according to this method, the apparatus preferably being made so as to be able to handle several rows of biscuits by each operation cycle.

6 Claims, 3 Drawing Figures

BISCUIT PACKING SYSTEMS

The present invention relates to packing of biscuits and similar products, and more specifically to methods and means for filling an elongated sales carton box with a pile of biscuits in such a manner that the biscuits assume an inclines position in the carton relatively to the axis of the pile. To an increasing degree different biscuit products are packed in elongated boxes of rectangular cross section adapted to rest on a table with one of their long sides, the top side of the box being open for receiving the biscuits, whereafter this side is closed e.g. by an easily removable transparent sheet material. At one end the box is provided with an inclines wall portion upstanding from the bottom so as to define a transverse biscuit support surface extending from the top of the end wall and downwardly-inwardly towards the bottom, e.g. at an angle of 45°. Hereby the biscuits are supported so as to generally be inclined 45° relatively to the length axis of the horizontal pile or row of biscuits as defined by the length dimension of the box.

While it is relatively easy to arrange the biscuits manually in the box in this manner there has been considerable difficulties in providing automatic means for carrying out the packing in connection with the delivery of biscuits from an industrial baking oven of the running-through or tunnel type, the biscuits in question normally being baked in an oven of this type.

It is the purpose of this invention to provide a method and an apparatus enabling the biscuits to be automatically piled and packed as described in a reliable and rapid manner.

According to the invention there is used an intermediate receptacle to which the biscuits are successively fed from the delivery end of the oven so as to be arranged with the desired pile shape in the receptacle, whereafter, when the receptacle is filled, one long side thereof is temporarily opened or removed and the prearranged pile is transferred to a packing box through the open receptacle side.

Figure 1:
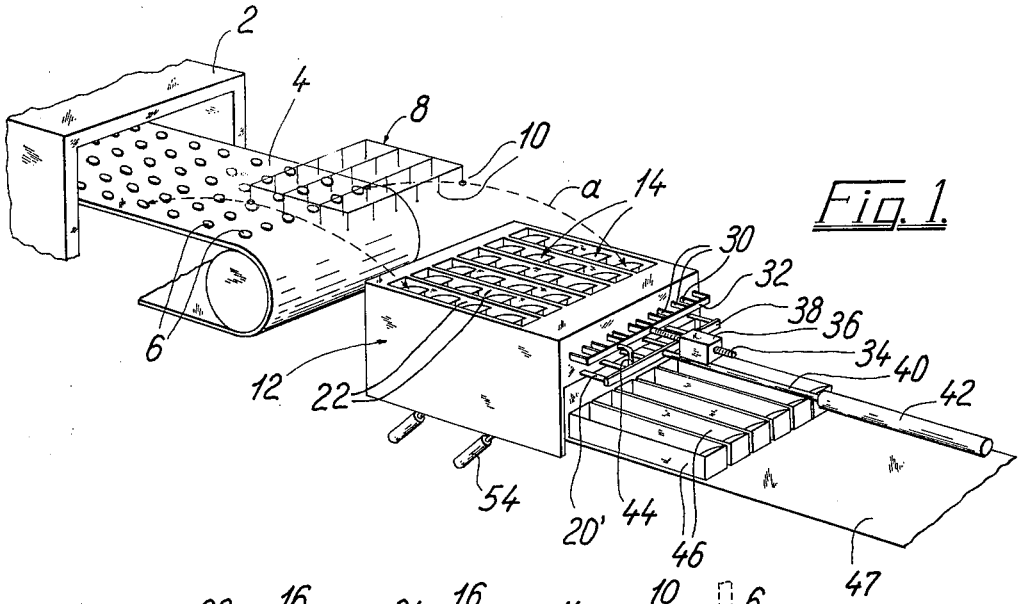
Figure 2:
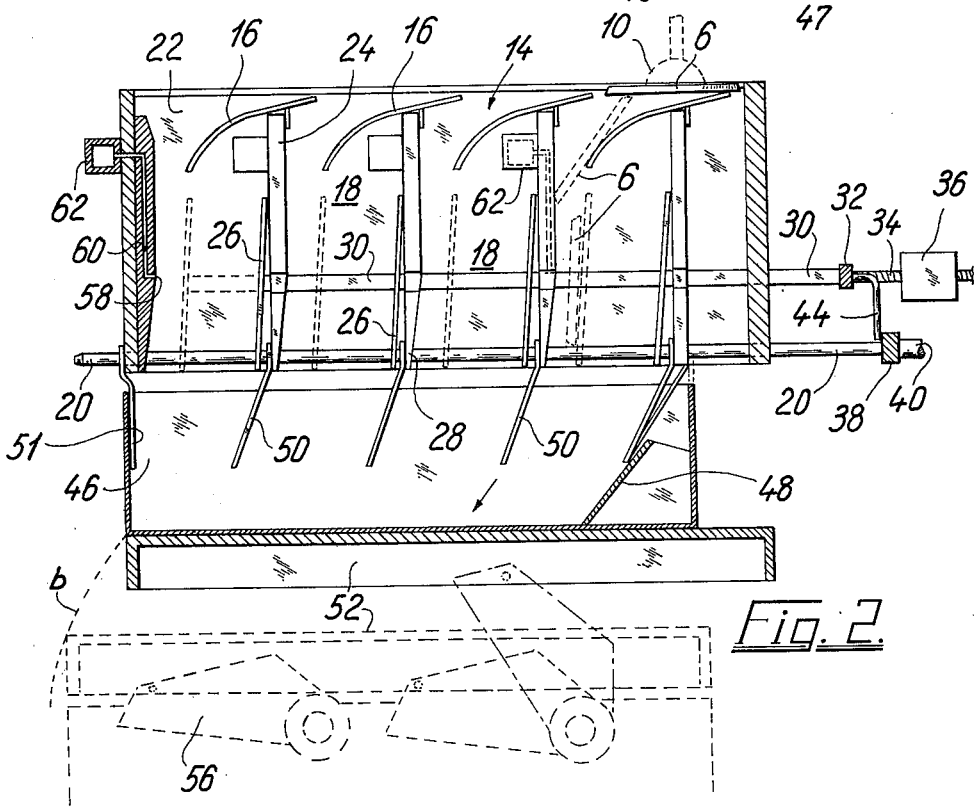
Figure 3:
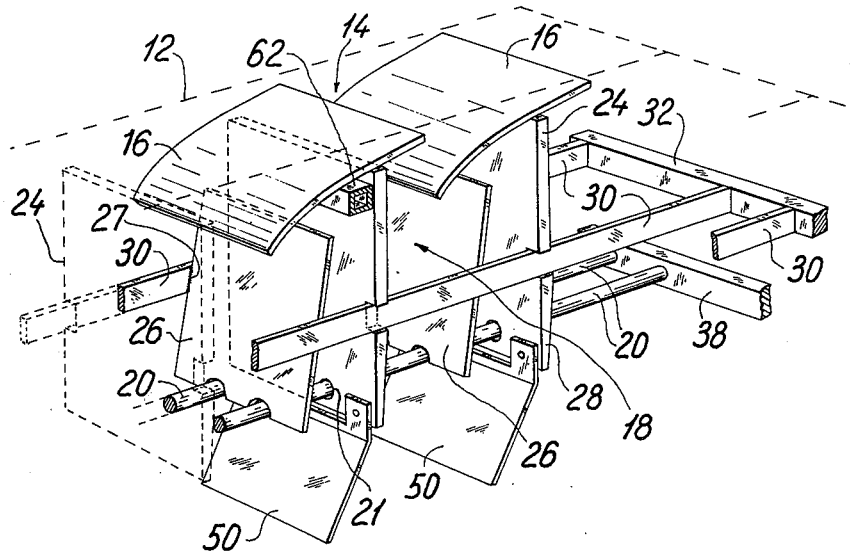

By way of example, an embodiment of a system according to the invention is illustrated in the accompanying drawing, in which:

FIG. 1 is a schematic perspective view of an apparatus for receiving the biscuits from an oven and stacking them in boxes in the manner described, FIG. 2 is a sectional side view of the apparatus, and FIG. 3 is a perspective fragmentary view illustrating details of the apparatus.

In FIG. 1 is shown a tunnel oven 2 the baking plate of which is made as an endless conveyor belt 4 on which the biscuits 6 are arranged in consecutive transverse rows. At the delivery or output end of the oven, this end being shown in FIG. 1, at least four rows of biscuits are exposed, whereby it is possible by automatic means to remove the biscuits in these rows and transfer them to the stacking apparatus described below. This removal and transfer may be made by an arrangement similar to that described in our British Patent Specification No. 1,305,901, i.e. including an overhead carrier structure 8 provided with a number of sucking heads 10 arranged so as to be able to pick up all the biscuits in the first four rows of the conveyor plate 4, preferably upon the biscuits being scraped off to well defined delivery positions as also described in our said earlier Patent Specification. The structure 8 is movable along an arched path as shown by the dotted arrows *a* so as to be reciprocable between a pick up position above the end of the conveyor plate 4 and a delivery position above the stacking apparatus, which is generally designated 12. The transfer system may correspond to that described in the earlier Patent Specification with the exception that it is here preferred to use a sucking head structure having sufficient sucking heads for handling four rows of biscuits in each operation cycle, though of course the figure four is taken as a practical example only.

The stacking device 12 is made as a box structure the top side of which is divided into 4 times 6 receptacle units 14 arranged so as to be operable to each receive a biscuit from the transfer structure, 6 being the number of biscuits in each row in the example shown; this number, of course, is an example only.

Each of the receptacle units 14 have a top plate 16 which is inclined in such a manner that when a biscuit, released from the particular sucking head upon reaching the position shown at the top of the right hand side of FIG. 2, is deposited on this plate the biscuit will slide down along the plate 16 and thus, due to the downwardly increasing inclination of this plate as most clearly illustrated in FIGS. 2 and 3, be turned into an upright position and fall down into a receptacle compartment 18 underneath the lower end of the inclined plate 16. The bottom of this compartment or rather the bottom of each of these compartments in each of the 6 longitudinal rows of these compartments is constituted by a pair of horizontal rods 20, on the top surface of which the falling biscuits are brought to rest. The rods 20, as explained below, are retractable for release of the biscuits in the different compartments 18.

Each compartment 18 is defined between two side walls 22, a front wall 24, and a rear wall 26. The front walls 24 are rigid vertical elements having forwardly tapering lower end portions 28 and serving to carry at their top the gliding plate 16 belonging to the next compartment 18. The rods 20 are most clearly shown in FIGS. 2 and 3. They pass through holes 21 in the lower ends of the rigid front wall plates 24 so as to be easily retractable therefrom. For each row of receptacle compartments the two bottom rods 20 are disposed symmetrically about the middle line of the aligned compartment bottoms. The two rods could be substituted by a flat strip as shown for the sake of simplicity at 20' in FIG. 1.

The rear walls 26 are constituted by inclined plate members which adjacent their side edges are rigidly secured, as shown at 27 in FIG. 3, to horizontal carrier strips or rods 30 mounted adjacent the opposed sides of the compartments 18 so as to be movable in the longitudinal direction of the device 12 between an initial position shown in dotted lines in FIG. 2 and a final position shown in full lines. For example, the rods or plate strips 30 may be interconnected by means of a transverse beam 32 to which there is secured a screw spindle 34 cooperating with a stationary gear motor 36 for rotating a driving screw inside the motor housing and thus reciprocate the plate members 26 as desired. The plate members 26 in their initial positions define a narrow vertical space behind the respective front walls 24, and the first biscuits sliding down along the plates 16 will be received in these spaces and assume a slightly inclined position therein, resting against the bottom rods 20 and the plate member 26. When the first set of biscuits has been transferred to the device 16 and the transfer structure 8 is moved away for picking up a new set of biscuits from the baking plate 4, the motor 36 is energized shortly for moving the inclined plates 26 one step rearwardly, corresponding to the thickness of a biscuit, and as explained below also the bottom rods 20 are moved correspondingly, whereby the biscuit is moved rearwardly and leaves space for the next biscuit to be received.

The bottom rods 20 are interconnected by means of a cross beam 38 to which there is secured a piston rod 40 of a cylinder 42 operable to retract the bottom rods entirely from their positions underneath the receptacle compartments. As illustrated schematically the upper cross beam 32 is provided with a fixed abutment arm 44 which engages loosely behind the cross beam 36; when the cross beam 32 is moved rearwardly for moving the plate members 26 the said steps rearwardly the abutment arm will cause the cross beam 38 and therewith the bottom rods 20 to be moved the same steps, and in this manner the biscuits already deposited on the rods will be moved as a whole, leaving the said space for the next biscuit to be received. Normally the biscuits will be supported in the horizontal cross direction by means of the strips or rods 30, and since these participate in the retraction of the plate members 26 the free retractability of the biscuits will not be compromised by any frictional engagement between the edges of the biscuits and the rigid side walls 22.

When the next set of biscuit has been transferred to the device 16 the plates 26 and the rods 20 are moved a further step, and this operation is continued until the receptacle compartments have been filled, e.g. with 4 or 5 biscuits each, whereby the plates 26 assume their final positions.

With the plates 26 in their final positions, as soon as the last set of biscuits has landed on the bottom rods 20 the cylinder 42 is actuated so as to cause full retraction of these rods 20 from all the compartments. Underneath each longitudinal row of compartments 18 there is placed a support for a carton box adapted to receive the biscuits as they are in this manner released from the compartments. One of these boxes is shown in a sectional view in FIG. 2. It is an elongated box 46 having at one end an inclined inner wall portion 48 projecting from the box bottom towards the upper end edge of the box, whereby it can support a biscuit in an inclined position, e.g. of 45°. At the lower ends of the front wall members 24 there are secured inclined guiding plates 50 which extend down into the box and serve to guide the biscuits in such a manner that they are deposited in the box in expressed inclined positions. When the box is thereafter moved downwardly the biscuits will fall or tilt to rest on each other with the rearmost biscuit supported on the wall portion 48, i.e. with all biscuits assuming uniform inclined positions in the desired manner.

The box 46 is supported by a lift support table 52 which is adapted to move up and down substantially in the direction of the lower guiding plates 50, whereby the filled box may be lowered without the lower ends of the guiding plates causing the biscuits to be raised to a vertical position. The direction of movement may even be still more inclined than the guiding plates, whereby the biscuits will be gently laid down into their final positions. Thus, as indicated schematically in FIG. 1, the support table may be moved by means of inclined working cylinders 54.

It is preferred, however, to let the support table 52 be pivotally connected with the outer ends of a pair of crank members 56 which are reciprocated by means not shown so as to move the table 52 along the dotted line *b*, whereby the release movement from the guiding plates 50 takes place in the desired direction. The foremost guiding plate is designated 51 and is not inclined; it projects vertically downwardly and serves as an abutment for the interior side of the left hand end of the box, whereby it constitutes a centering means for the box.

In the lower position of the support table 52 the filled boxes may be removed and new boxes placed on the table. This exchange may be carried out in any convenient manner, also fully automatically, but it is not the purpose of the invention to describe this function in more detail. However, in FIG. 1 is shown a transverse row of boxes 46 resting on a support table or conveyor 47 so as to be ready to be pushed forwardly onto the lift support 52 when this support assumes its lowered position.

As soon as the biscuits have left the compartments the motor 36 is actuated so as to move the plate members 26 back into their initial positions, and the cylinder 42 is actuated for bringing the bottom rods 20 back into their operative positions, before the next set of biscuits is received by the continued operation of the transfer system. This, of course, takes a certain time, but it will be appreciated that sufficient time may be provided for due to the fact that the transfer system handles several transverse rows of biscuits at the same time, i.e. in each operation stroke.

It can be difficult to ensure that the biscuits are really deposited in a rearwardly inclined position on the bottom rods 20 upon their sliding down along the upper plate members 16, so a special security arrangement has been provided to this end, i.e. for ensuring that the biscuits are brought to rest against the plate members 26 in a position in which they follow the stepwise retraction of these plates and thus clear the space in front of them for receiving the next biscuits. This arrangement comprises a compressed air nozzle 58 mounted in the front wall portion 24 of each compartment and operating to send an air jet against the upper half of the biscuits deposited on the bottom rods 20. Experiments have shown that this is sufficient for obtaining the desired result. The nozzles 58 are fed through channels 60 connected to distributor tubes 62 mounted crosswise in the device 12 underneath the top plates 16 and above the top of the plate members 26.

The invention is in no way limited to the embodiment shown and described, since numerous modifications are possible within the scope of the invention. Thus, the inclined guiding plates 16 could be avoided if the biscuit transfer system is adapted to otherwise deliver the biscuits to the front end of the receptacles with the biscuits assuming an upright position, e.g. if the sucking heads 10 are mounted so as to be able to swing the biscuits into a substantially vertical position prior to releasing the biscuits. For the invention itself it is not of primary importance how the biscuits are delivered to the inlet openings of the piling compartments 18, but it will be appreciated that the preferred system as schematically illustrated in FIG. 1 can be made so as to operate in a rapid and reliable manner.

What is claimed is:

1. An apparatus for piling and packing biscuits and similar flat cakes and comprising a piling receptacle having a retractable bottom portion operable to support a number of biscuits placed generally edgewise thereon, an inlet opening located above said bottom portion and through which biscuits are consecutively introduceable into the receptacle so as to be supported by said bottom portion, a horizontally displaceable end wall member operable to support a first biscuit standing on said bottom portion in a slanting position leaned against said wall member, control means for gradually moving said end wall member rearwardly from an initial position adjacent said inlet opening so as to bring the said first biscuit away from the position in which it was introduced through the inlet opening and thus provide space for the following consecutive biscuits to be introduced into the receptacle and form a lying pile therein, and outlet control means operable to retract said bottom portion for releasing the pile of biscuits in the receptacle and allowing the pile to fall down into a box situated on support means underneath said receptacle.

2. An apparatus according to claim 1, comprising a number of aligned piling receptacles and control means for simultaneously moving said end wall members thereof, and said outlet control means being operable to release the bottom portions of the receptacles substantially simultaneously.

3. An apparatus according to claim 1, in which the bottom portion of the receptacle is connected with said end wall member so as to be operable to participate in the gradual rearward movement thereof.

4. An apparatus according to claim 1, in which at the top of the receptacle there is provided an inclined support plate member operable to receive a biscuit and forming a chute along which the biscuit may slide to said inlet position.

5. An apparatus according to claim 1, in which in a fixed end wall portion of the receptacle in front of the rearwardly movable end wall member there is provided an air nozzle operable to blow an air jet against the front side of the last introduced biscuit in the receptacle.

6. An apparatus according to claim 2, in which underneath the bottom portions of the receptacles there is mounted a number of stationary, inclined guiding plates operable to guide the biscuits downwardly into an underlying packing box, and in which a support member for said packing box is arranged underneath the receptacles so as to be reciprocal substantially in the direction of the inclined guiding plates between a raised position in which the guiding plates extend down into a packing box standing on said support, and a lower position in which the top side of the box is situated in a level underneath the lower ends of the guiding plates.

* * * * *